US007264711B2

(12) United States Patent
Zwick

(10) Patent No.: US 7,264,711 B2
(45) Date of Patent: Sep. 4, 2007

(54) PROCESS FOR CONVERTING OIL SHALE INTO PETROLEUM

(76) Inventor: Dwight W. Zwick, 7711 S. Rosemary Way, Englewood, CO (US) 80112

( * ) Notice: Subject to any disclaimer, the term of this patent is extended or adjusted under 35 U.S.C. 154(b) by 336 days.

(21) Appl. No.: 10/222,379

(22) Filed: Aug. 16, 2002

(65) Prior Publication Data

US 2003/0080029 A1 May 1, 2003

Related U.S. Application Data

(60) Provisional application No. 60/313,267, filed on Aug. 17, 2001.

(51) Int. Cl.
*C10G 1/00* (2006.01)

(52) U.S. Cl. ..... 208/435; 208/428; 208/430

(58) Field of Classification Search ..... 208/428, 208/430, 435

See application file for complete search history.

(56) References Cited

U.S. PATENT DOCUMENTS

| | | | | |
|---|---|---|---|---|
| 3,617,471 A | | 11/1971 | Schlinger | |
| 3,891,403 A | | 6/1975 | Weil | |
| 4,108,760 A | * | 8/1978 | Williams et al. | 208/390 |
| 4,158,638 A | | 6/1979 | Tsai | |
| 4,238,315 A | * | 12/1980 | Patzer, II | 208/435 |
| 4,321,127 A | | 3/1982 | Atwood | |
| 4,404,083 A | | 9/1983 | Vasalos | |
| 4,428,821 A | * | 1/1984 | Baset | 208/428 |
| 4,437,973 A | | 3/1984 | Huibers | |
| 4,495,059 A | | 1/1985 | Wallman | |
| 4,568,446 A | | 2/1986 | Audeh | |
| 4,605,487 A | | 8/1986 | Michel | |
| 4,687,570 A | | 8/1987 | Sundaram | |
| 4,695,373 A | | 9/1987 | Ho | |
| 4,698,149 A | | 10/1987 | Mitchell | |
| 4,798,668 A | | 1/1989 | Ho | |
| 5,132,007 A | | 7/1992 | Meyer | |
| 5,266,189 A | * | 11/1993 | Joseph et al. | 208/400 |
| 5,269,909 A | | 12/1993 | Ovalles | |
| 5,891,829 A | | 4/1999 | Vallejos | |

FOREIGN PATENT DOCUMENTS

| | | | |
|---|---|---|---|
| CA | 1180294 A | * | 1/1985 |
| GB | 2076012 A | * | 11/1981 |

* cited by examiner

*Primary Examiner*—Glenn Caldarola
*Assistant Examiner*—John Douglas
(74) *Attorney, Agent, or Firm*—Brian D Smith, P.C.

(57) ABSTRACT

A process for converting oil shale into petroleum is disclosed. The process includes the steps of pulverizing oil shale to produce pulverized oil shale and then preparing a mixture of pulverized oil shale, water and ethyl alcohol in a sealed vessel. The mixture in the sealed vessel is then heated to a temperature of at least about 465° F. for a period of time which is sufficient to cause the oil shale and ethyl alcohol to combine to produce a second mixture of petroleum and water. The water is then separated from the petroleum.

17 Claims, 1 Drawing Sheet

PROCESS FOR CONVERTING OIL SHALE INTO PETROLEUM

CROSS REFERENCE TO RELATED APPLICATIONS

This application is a nonprovisional application claiming the benefit under 35 USC 119(e) of U.S. provisional application Ser. No. 60/313,267, filed on Aug. 17, 2001.

TECHNICAL FIELD

The present invention relates generally to processes for converting oil shale into petroleum and, more particularly, to an economically viable process for accomplishing such.

BACKGROUND OF THE INVENTION

Eons ago alternate layers of mud and organic matter were deposited at the bottom of a sea. Thousands of feet of overburden formed over the layers. If an impermeable capstone had formed over the petroleum, an oil pool would be available for tapping today. Either a cap did not form or one formed and was subsequently eroded away. In either case the absence of a cap has allowed the light ends of the petroleum to escape to the atmosphere, thereby, leaving the asphalt remainder.

In the recent past attempts have been made to extract hydrocarbons from oil shale by cooking it at high temperature in an enclosed pressure vessel. This "cracks" the molecular chain of the asphalt and releases some lighter compounds which when cooled form liquid petroleum. The petroleum thus formed is heavy crude of less than average value. The yield of crude is low and the cost of extraction is high. Therefore, there are no American oil shale processing facilities in operation.

Other technologies have been suggested, such as removal of the oil by using a solvent which then needs to be distilled from the oil-solvent mixture for reuse. However, none of the suggestions have produced an economical process.

DISCLOSURE OF THE INVENTION

To make oil shale processing economical it is necessary to reverse the process by which petroleum became shale. This requires reintroducing the light hydrocarbons which have evaporated. My idea proposes boiling pulverized oil shale in a pressure vessel while pumping ethyl alcohol into the vessel. Exhibit One shows a schematic of the process.

Under high-pressure the water and ethyl alcohol would both circulate around the pulverized oil shale. The close proximity allows the alcohol to combine with the oil shale to form petroleum.

Each raw oil shale batch would vary slightly and oil shale from random locations would vary considerably, therefore, the amounts of ethyl alcohol and the temperature would be adjusted based upon the raw oil shale sample. Furthermore, by controlling the inputs of ethyl alcohol, it would be possible to vary the end product.

Water would be introduced into each batch in order to provide a medium in which the components could interact. When the process is complete, the end product and excess water would be drained to an oil-water separator. Thereafter, the excess water would be reused.

The non-hydrocarbon portion of the oil shale will remain in the bottom of the vessel where it can be removed and the vessel recharged.

The above described batch process can be incorporated into a continuous process, however, to simplify the description, the process is described as a batch process.

DETAILED DESCRIPTION OF PREFERRED EMBODIMENTS

Figure 1:
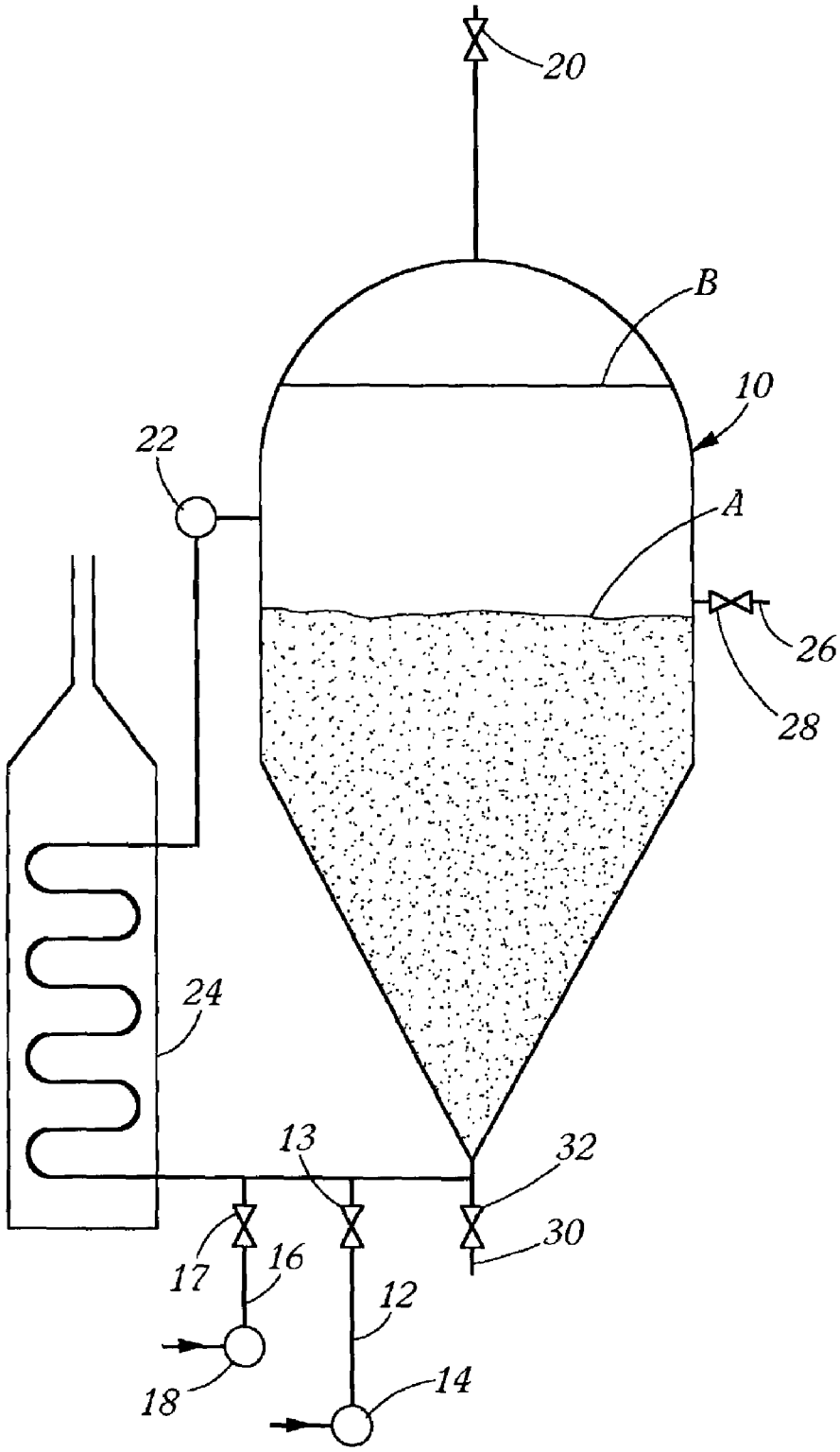
FIG. 1 is a schematic representation of a process for converting oil shale into petroleum in accordance with the invention disclosed herein.

There is no single formula that describes petroleum. Petroleum deposits vary widely in physical and chemical properties. A complete analysis of any petroleum sample will show that the sample is composed of millions of compounds. The bulk of the compounds are hydrocarbons. As the name implies a hydrocarbon consists of hydrogen and carbon only. Even though only two elements are present, the number of compounds which can form is very large. This is due to the ability of the carbon atom to combine with other carbon atoms to form long chains.

The paraffin series is an example of one important hydrocarbon series. The general formula for the paraffin series is $C_nH_{2n+2}$. The general rule is that paraffin series molecules composed of one to four carbon atoms are gases. Those with five to seventeen carbon atoms are liquids and those with eighteen or more carbon atoms are solids. The below table shows a partial list of the paraffin series showing molecules formed from the formula $C_nH_{2n+2}$:

| | NAME | STATE |
|---|---|---|
| $CH_4$ | methane | gas |
| $C_2H_6$ | ethane | gas |
| $C_3H_8$ | propane | gas |
| $C_4H_{10}$ | butane | gas |
| $C_5H_{12}$ | pentane | liquid |
| $C_6H_{14}$ | hexane | liquid |
| $C_7H_{16}$ | heptane | liquid |
| $C_8H_{18}$ | octane | liquid |
| $C_9H_{20}$ | | liquid |
| $C_{10}H_{22}$ | | liquid |
| $C_{11}H_{24}$ | | liquid |
| $C_{12}H_{26}$ | | liquid |
| $C_{13}H_{28}$ | | liquid |
| $C_{14}H_{30}$ | | liquid |
| $C_{15}H_{32}$ | | liquid |
| $C_{16}H_{34}$ | | liquid |
| $C_{17}H_{36}$ | | liquid |
| $C_{18}H_{38}$ | | solid |

The first member of the paraffin series is methane. In the general paraffin formula $C_nH_{2n+2}$, where n is one, methane has the formula $CH_4$. This is represented by the below structural formula:

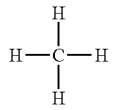

The second member is ethane whose formula is $C_2H_6$. Its structural formula is:

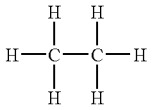

The third member is propane whose formula is $C_3H_8$. Its structural formula is:

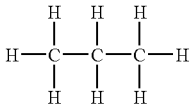

It becomes evident that each carbon atom added to the chain allows two hydrogen atoms to be added. When the chain includes eighteen or more carbon atoms the compound is a solid. Oil shale contains compounds with eighteen or more carbon atoms. To break the long chains it is necessary to add hydrogen to the chain under pressure and temperature. Ethyl alcohol with the formula $C_2H_6O$ will furnish the hydrogen atoms necessary to break the solid oil shale atoms.

Full knowledge of the reconversion process will not be obtained until the process of the present invention described herein has been in operation for many years.

Tar Sands:

The process of the present invention will convert tar sands into petroleum in exactly the same manner as described above for oil shale.

Basic Principal:

UNDER HIGH PRESSURE AND TEMPERATURE, LONG CHAIN, OIL SHALE HYDROCARBONS IN THE PRESENCE OF ETHYL ALCOHOL, WILL CONVERT TO CRUDE PETROLEUM.

Hydrocarbons occur in thousands of combinations, nevertheless, only a single cracking equation is herein included. Additional equations are not included because all equations would show exactly the same point. This one equation is adequate to prove the concept as shown by the below diagram of two ethyl alcohol molecules. Under high pressure and temperature the two alcohol molecules disintegrate to form six molecular "ends". These ends adhere to and stabilize the pieces which are broken off any long chain hydrocarbon molecule.

THE BASIC PRINCIPAL GOVERNING THE CRACKING OF LONG CHAIN, OIL SHALE MOLECULES IS THAT A SINGLE HYDROGEN ATOM MUST BE ATTACHED TO BOTH ENDS OF EACH SURVIVING MOLECULE.

Ethyl Alcohol Diagram:

Two molecules of ethyl alcohol provide six ends as shown below:

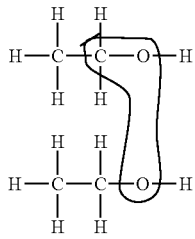

The encircled atoms form $CO_2$. The remaining atoms form three unstable H atoms and three unstable groupings of:

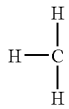

These six unstable ends will attach to the end of any segment broken from a long chain hydrocarbon. Once an unstable end has attached to each end of a broken segment, it becomes a stable compound. In the example shown below a long chain oil shale molecule is broken into four segments and the six unstable ends attach to the broken portions to form four stable new molecules.

Oil Shale Molecule:

When $C_{32}H_{66}$ is broken into four segments of eight carbon atoms each, the unstable pieces appear as shown below:

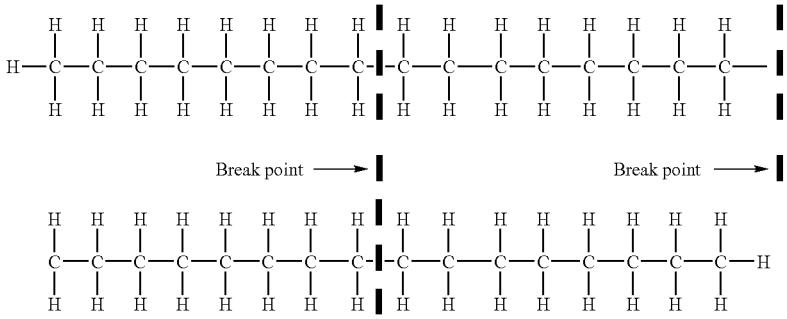

Each segment must have a hydrogen atom attached at both ends or it will not be stable and will recombine with the long chain to remain a solid. Therefore the four stable molecules take the following form:

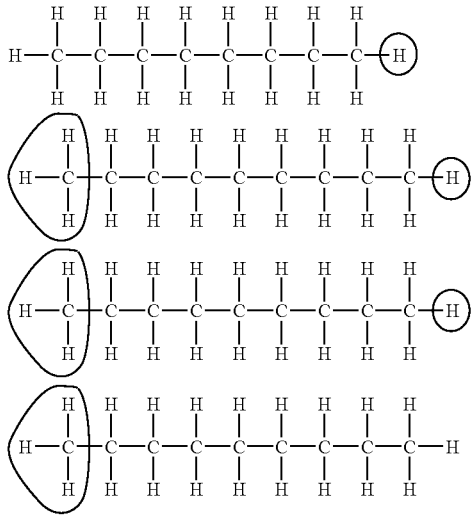

The circled portions of the four molecules represent the six unstable ends now incorporated into the four stable molecules. Note that the original long chain oil shale molecule had a hydrogen atom on each end, so the four segments had only six uncovered ends.

Oil Shale Cracking Equation:

The below equation represents the cracking of a $C_{32}H_{66}$ molecule:

Temp.

$$C_{32}H_{66}+2C_2H_6O \rightarrow CO_2+C_8H_{18}+3C_9H_{20}$$

The primary deficiency in cracking oil shale with alcohol is that the oxygen forms carbon dioxide which must at some point, be exhausted without losing the hydrocarbons. This can be accomplished by employing a cool upper pressure chamber which allows the hydrocarbons to condense before the carbon dioxide is exhausted.

Yield of Petroleum:

In order to determine whether or not converting oil shale to petroleum using alcohol is economical, it is necessary to first determine the relative yield of petroleum to alcohol expended.

The relative weights of petroleum and alcohol can be calculated by substituting atomic weights into the above equation.

The atomic weight of carbon is 14. The atomic weight of hydrogen is 1 and the atomic weight of oxygen is 12. Those weights can be imputed into the above equation to find the atomic weights of alcohol and petroleum compounds as shown below:

| | Formula | Atomic Weight |
|---|---|---|
| Ethyl alcohol: | $C_2H_6O$ | 14 × 2 + 1 × 6 + 12 = 46 |
| Octane: | $C_8H_{18}$ | 14 × 8 + 1 × 18 = 130 |
| Nonane: | $C_9H_{20}$ | 14 × 9 + 1 × 20 = 146 |

Therefore two ethyl alcohol molecules of atomic weight 46 each, produce one Octane molecule of atomic weight 130 and three Nonane molecules of atomic weight 146. Therefore ethyl alcohol converts $C_{32}H_{66}$ shale into petroleum in the following proportion (by weight):

$$\text{Conversion ratio: } \frac{130+3\times 146}{2\times 46} = \frac{568}{92} = 6.174^1$$

Cost of Oil Shale Crude:

If a 42-gallon barrel of ethyl alcohol is worth $84, the cost for the alcohol portion of the petroleum would be:

$84/6.174=$13.61/barrel[2]

[2]Assumes crude oil API of 50 which has a specific gravity of 0.779. Ethyl alcohol has a specific gravity of 0.789.

In addition to the cost of alcohol there would be overhead. The total cost would equate oil shale to crude oil at about $22 per barrel.

Efficient Use of Natural Resources:

One of the reasons that present oil shale cracking technology is economically impractical is that the recovery percent yield is low. The herein described process not only has a high percentage yield, the total is higher than one hundred percent, since the weight of the ethyl alcohol becomes incorporated into the final petroleum.

EXAMPLES

The invention will be further described with reference to the following contemplated examples.

Several 50 to 80 pound solid stones of Western Colorado oil shale are to be ground to a mesh size of about 10 to about 200 U.S. Standard sieve. When about 500 pounds of ground oil shale is produced, the entire amount is to be placed in a clean cement mixer and mixed for 40 minutes.

Three samples of 100 pounds each are then to be separated and taken for use in conducting the following examples. From the ground oil shale still in the mixer, samples are to be taken to determine the percentage relationship between the Kerogen and impurities in the ground oil shale. Kerogen is the hydrocarbon component of oil shale which is to be converted into petroleum in accordance with the process of the present invention. The impurities, primarily clay, are expected to comprise about 29 percent by weight of the samples.

Example One

A sample of one hundred pounds of pulverized oil shale is to be deposited in a pressure vessel 10 to a level indicated by line A of FIG. 1. The sample is expected to contain approximately 71 pounds of carbon and hydrogen (Kerogen) and 29 pounds of sand, clay and other impurities. 12.2 pounds of 190 proof grain alcohol are to be added to the sample via line 12, valve 13 and pump 14. The vessel is then filled with water via line 16, valve 17 and pump 18 to 90 percent of its capacity as indicated by line B of FIG. 1 and then is closed and sealed with valve 20. Pump 22 of FIG. 1 is then started and the flame in boiler 24 is ignited to heat the mixture in the vessel to a temperature of about 520° F. Pump 22 circulates the heated mixture in the vessel for two hours. The pressure in the vessel is expected to rise to about 500 psig (not absolute).

At the end of two hours, the flame in boiler 24 is extinguished and pump 22 is turned off. The vessel is then allowed to cool and when cooled is opened. The mixture is expected to contain petroleum floating on water. The petroleum is then siphoned out of the vessel via line 26 and valve 28 into a scale-mounted container (not shown) and weighed. The total weight of the petroleum is expected to be about 73 pounds. The residue in the bottom of the vessel is removed from the vessel via line 30 and valve 32. The residue is expected to contain visible carbon.

Example Two

A sample of one hundred pounds of pulverized oil shale is to be deposited in a pressure vessel 10 to a level indicated by line A of FIG. 1. The sample is expected to contain approximately 71 pounds of carbon and hydrogen (Kerogen) and 29 pounds of sand, clay and other impurities. 12.2 pounds of 190 proof grain alcohol are to be added to the sample via line 12, valve 13 and pump 14. The vessel is then filled with water via line 16, valve 17 and pump 18 to 90 percent of its capacity as indicated by line B of FIG. 1 and then is closed and sealed with valve 20. Pump 22 of FIG. 1 is then started and the flame in boiler 24 is ignited to heat the mixture in the vessel to a temperature of about 620° F. Pump 22 circulates the heated mixture in the vessel for two hours. The pressure in the vessel is expected to rise to about 525 psig (not absolute).

At the end of two hours, the flame in boiler 24 is extinguished and pump 22 is turned off. The vessel is then allowed to cool and when cooled is opened. The mixture is expected to contain petroleum floating on water. The petroleum is then siphoned out of the vessel via line 26 and valve 28 into a scale-mounted container (not shown) and weighed. The total weight of the petroleum is expected to be about 74 pounds. The residue in the bottom of the vessel is removed from the vessel via line 30 and valve 32. The residue is expected to contain some visible carbon.

Example Three

A sample of one hundred pounds of pulverized oil shale is to be deposited in a pressure vessel 10 to a level indicated by line A of FIG. 1. The sample is expected to contain approximately 71 pounds of carbon and hydrogen (Kerogen) and 29 pounds of sand, clay and other impurities. 12.2 pounds of 190 proof grain alcohol are to be added to the sample via line 12, valve 13 and pump 14. The vessel is then filled with water via line 16, valve 17 and pump 18 to 90 percent of its capacity as indicated by line B of FIG. 1 and then is closed and sealed with valve 20. Pump 22 of FIG. 1 is then started and the flame in boiler 24 is ignited to heat the mixture in the vessel to a temperature of about 720° F. Pump 22 circulates the heated mixture in the vessel for two hours. The pressure in the vessel is expected to rise to about 550 psig (not absolute).

At the end of two hours, the flame in boiler 24 is extinguished and pump 22 is turned off. The vessel is then allowed to cool and when cooled is opened. The mixture is expected to contain petroleum floating on water. The petroleum is then siphoned out of the vessel via line 26 and valve 28 into a scale-mounted container (not shown) and weighed. The total weight of the petroleum is expected to be about 75 pounds. The residue in the bottom of the vessel is removed from the vessel via line 30 and valve 32. The residue is expected to contain traces of carbon.

TABLE OF EXPECTED RESULTS

| | Example | | |
|---|---|---|---|
| | 1 | 2 | 3 |
| Pounds of Kerogen | 71 | 71 | 71 |
| Pounds of Impurities | 29 | 29 | 29 |
| Pounds of 190 proof alcohol | 12.2 | 12.2 | 12.2 |
| Time of Test | 2 hours | 2 hours | 2 hours |
| Temperature | 520° F. | 620° F. | 720° F. |
| Pressure | 500 psig | 525 psig | 550 psig |
| Yield-pounds | 73 | 74 | 75 |

While preferred embodiments of the present invention have been shown and described, it is to be understood that this was done only by way of example, and not as a limitation upon the scope of the invention.

I claim:

1. A process for recovering oil from oil shale comprising:

pulverizing oil shale containing kerogen to produce pulverized oil shale;

preparing a first mixture of pulverized oil shale, water and ethyl alcohol;

heating and pressurizing the mixture to a temperature between about 300 and 720° F. and a pressure between about 400 and 3300 psig for a period of time which is sufficient to cause the oil shale and ethyl alcohol to combine to produce a second mixture of water and petroleum wherein between about 5 and 7 pounds of petroleum are produced for every pound of ethyl alcohol in the first mixture; and separating the water from the petroleum.

2. A process according to claim 1 wherein said oil shale is pulverized to a mesh size ranging from about 10 to about 400 U.S. Standard sieve.

3. A novel process according to claim 1 wherein said oil shale is pulverized to a mesh size ranging from about 20 to about 200 U.S. Standard sieve.

4. A novel process according to claim 1 wherein said ethyl alcohol is a gas under reaction conditions.

5. A novel process according to claim 1 wherein said first mixture is pressurized between about 450 and 3300 psig.

6. A process according to claim 1 wherein said first mixture is pressurized between about 500 and 1500 psig.

7. A process according to claim 1 wherein said first mixture is pressurized to about 510 psig.

8. A process according to claim 1 wherein said first mixture is heated to a temperature between about 465 and 720° F.

9. A process according to claim 1 wherein said first mixture is heated to a temperature between about 470 and 600° F.

10. A process according to claim 1 wherein about 100 pounds of petroleum are produced for every 100 pounds of kerogen contained in the oil shale.

11. A process for recovering oil from oil shale consisting essentially of:

a. pulverizing oil shale containing kerogen to produce pulverized oil shale;

b. preparing a first mixture of pulverized oil shale, water and ethyl alcohol in a sealed vessel;

c. heating the first mixture in the sealed vessel to a temperature of at least about 465° F. for a period of time which is sufficient to cause the oil shale and ethyl alcohol to combine to produce a second mixture of petroleum and water wherein about 100 pounds of petroleum are produced for every 100 pounds of kerogen contained in the oil shale; and d. separating the water from the petroleum.

12. A process according to claim 11 wherein said first mixture reaches a pressure of between about 450 and 3300 psig.

13. A process according to claim 11 wherein said first mixture reaches a pressure of between about 500 and 1500 psig.

14. A process according to claim 11 wherein said first mixture is heated to a temperature between about 465 and 720° F.

15. A process according to claim 11 wherein about 6 pounds of petroleum are produced for every pound of ethyl alcohol in said first mixture.

16. A process for recovering oil from pulverized oil shale consisting essentially of:

a. preparing a first mixture of pulverized oil shale containing kerogen, water and ethyl alcohol in a sealed vessel;

b. heating the first mixture in the sealed vessel to a temperature of at least about 465° F. for a period of time which is sufficient to cause the oil shale and ethyl alcohol to combine to produce a second mixture of petroleum and water wherein the amount by weight of petroleum is greater than the amount by weight of kerogen contained in the oil shale and wherein between about 5 and 7 pounds of petroleum are produced for every pound of ethyl alcohol in the first mixture; and c. separating the water from the petroleum.

17. A process according to claim 16 wherein more than 105 pounds of petroleum are produced for every 100 pounds of kerogen contained in the oil shale.

* * * * *